US008312605B1

(12) United States Patent
Rider

(10) Patent No.: US 8,312,605 B1
(45) Date of Patent: Nov. 20, 2012

(54) BELT-DRIVE ROOF PANEL SEAMING APPARATUS

(76) Inventor: Terry L Rider, Corinth, MS (US)

( * ) Notice: Subject to any disclaimer, the term of this patent is extended or adjusted under 35 U.S.C. 154(b) by 579 days.

(21) Appl. No.: 12/467,095

(22) Filed: May 15, 2009

(51) Int. Cl.
*B23P 17/00* (2006.01)

(52) U.S. Cl. ..... 29/243.5; 29/243.517

(58) Field of Classification Search ..... 29/243.5, 29/243.517, 243.56, 243.58, 243.57, 243.528
See application file for complete search history.

(56) References Cited

U.S. PATENT DOCUMENTS

| | | | | | |
|---|---|---|---|---|---|
| 2,171,297 | A | | 2/1939 | Zahner et al. | |
| 2,160,336 | A | | 5/1939 | Maxfield | |
| 3,610,191 | A | | 10/1971 | Harris, Jr. | |
| 3,771,482 | A | | 11/1973 | Thompson | |
| 3,875,642 | A | * | 4/1975 | Knudson | 29/243.5 |
| 4,027,611 | A | | 6/1977 | Ward et al. | |
| 4,168,596 | A | | 9/1979 | Yoder, Jr. | |
| 4,470,186 | A | | 9/1984 | Knudson | |
| 4,726,107 | A | | 2/1988 | Knudson | |
| 4,918,797 | A | * | 4/1990 | Watkins et al. | 29/243.5 |
| 4,989,308 | A | | 2/1991 | Sanders | |
| 5,142,838 | A | | 9/1992 | Simpson et al. | |
| 5,303,528 | A | | 4/1994 | Simpson | |
| 5,604,966 | A | | 2/1997 | Morella et al. | |
| 5,655,279 | A | * | 8/1997 | Ehrlich | 29/243.5 |
| 5,685,118 | A | | 11/1997 | Simpson | |
| 5,697,197 | A | | 12/1997 | Simpson | |
| 5,737,894 | A | | 4/1998 | Simpson et al. | |
| 5,935,357 | A | | 8/1999 | Hubbard et al. | |
| 5,991,993 | A | * | 11/1999 | Knudson | 29/243.5 |
| 6,115,899 | A | * | 9/2000 | Rider | 29/243.5 |
| 6,187,122 | B1 | | 2/2001 | Hubbard et al. | |
| 6,499,203 | B2 | | 12/2002 | Morella | |
| 6,588,170 | B2 | | 7/2003 | Simpson et al. | |
| 6,722,087 | B1 | | 4/2004 | Morella | |
| 6,889,478 | B1 | | 5/2005 | Simpson | |
| 2010/0077595 | A1 | * | 4/2010 | Rider | 29/509 |

* cited by examiner

*Primary Examiner* — Lee D Wilson
(74) *Attorney, Agent, or Firm* — Wyatt, Tarrant & Combs, LLP; William S. Parks

(57) ABSTRACT

A self-propelled apparatus for the seaming of roof assemblies for a building structure, wherein the apparatus includes belt components for the alignment of panel edges in order for engagement of horizontal rollers to perform the seaming procedure is provided. Such an apparatus exhibits a greatly reduced propensity for potentially marring, distorting, or otherwise misaligning the panel edges due to uniform pressures exerted on the target panel surfaces during use. In addition, the inventive belt-drive apparatus exhibits a much lower potential for slippage during use than an apparatus utilizing multiple rollers to apply proper force during a seaming operation. The method of seaming with such an apparatus is also encompassed within this invention.

4 Claims, 10 Drawing Sheets

BELT-DRIVE ROOF PANEL SEAMING APPARATUS

FIELD OF THE INVENTION

The present invention relates to a self-propelled apparatus for the seaming of roof assemblies for a building structure, wherein the apparatus includes belt components for the alignment of panel edges in order for engagement of horizontal rollers to perform the seaming procedure. Such an apparatus exhibits a greatly reduced propensity for potentially marring, distorting, or otherwise misaligning the panel edges due to uniform pressures exerted on the target panel surfaces during use. In addition, the inventive belt-drive apparatus exhibits a much lower potential for slippage during use than an apparatus utilizing multiple rollers to apply proper force during a seaming operation. Reduced crimping, dimpling, creasing, and the like, provides greater reliance of the finished assembled seamed roof in terms of waterproofing and uplift protection as well as to best ensure the seaming apparatus does not jam or otherwise fail during the seaming process itself. A second belt component may also be added in perpendicular relation to the first for further improvements in pressure exertion and thus overall reliability of the seaming operation. The method of seaming with such an apparatus is also encompassed within this invention.

BACKGROUND OF THE INVENTION

Standing seam roof assemblies have been utilized for simpler manufacturing, particularly in order to reduce complexity in erecting buildings. In such assemblies, numerous panels are supplied with differing end portions, each having what is termed a female portion and a smaller male portion. In such a manner, the panels are laid one next to the other and secured through seaming the male and female portions of adjacent panels together. Such roof assemblies are designed to provide excellent watertight seals as well as effective wind resistance to ensure leak-proof structures as well as high stability against updrafts. Additionally, the seams include panel portions that are allowed to flex to compensate for temperature variations so the roof itself will not disintegrate upon contraction or protraction. For simplification of the overall assembly system, the seamed panels are attached to the building structure via brackets or like components, at a limited number of points in each connected panel. Thus, it is very important to provide excellent seal strengths upon seaming of such individual roof assembly panels together in order ensure the roof assembly does not destabilize at the seam attachment points. As well, the seaming procedure is generally accomplished through the utilization of a motorized seaming apparatus that moves along the length of overlapping edges of adjacent panels.

The panels themselves are made generally from metal materials that exhibit excellent strength characteristics, low propensity for rusting, and, of great importance, suitable flexibility for seaming to be accomplished. A seam between the two panels should provide not only waterproof seals between panels, but also the ability to hold two panels together effectively to prevent or at least substantially reduce any slippage between them. Any appreciable reduction in the dimensional stability of the roof assembly itself would result in roof failure from a leakage perspective, at least.

Typical self-propelled seaming devices include cylindrical rollers to contact vertical roofing panels in order to not only apply sufficient pressure to permit the seaming components of the device to perform as needed between the male and female portions of separate panels, but also to provide the propulsion of the device along the length of the contacted vertical portions of such panels as well. Such rollers, unfortunately, although the standard within the industry up to the present date, have exhibited certain drawbacks in performance that have led to potentially suspect results for seamed roof assemblies. For instance, since a series of rollers are utilized within these seaming devices, at no time with a uniform pressure be exerted along the entire length of the target panels since gaps in contact points will always exist (the rollers must have some separation, in other words). As such, there exists the potential for slippage over the length of the target panel by the rollers themselves. A reduced contact area may contribute to misalignment of the panel, particularly at lap joints and clip locations over the entire assembly. This, in turn, may lead to weakened stress points, creating a distinct possibility for weakening of the entire structure, or, at least, the potential for water leakage and/or wind draft problems.

Furthermore, the lack of constant contact with the target panel, and thus only tangential contact intermittently across a panel length, causes the aforementioned propensity for creasing, dimpling, as well as possible scratching and/or marring. With the seaming portions of the apparatus providing their own intermittent force over the length of the conjoined panels during the seaming operation, unevenness in pressure application leads to such potential aesthetically displeasing results over the resultant seamed panels. Unfortunately, such displeasing results are not limited to aesthetic issues as marring, dimpling, etc., may lead to similar problems as noted above, particularly weakening of the overall seam and greater possibility of water damage, rusting, and wind draft failures.

Improvements in seaming devices have basically been limited to providing differing angles and sizes of seaming portions (posts) in order to initiate a first degree of seaming distance, followed by further enhancements during the seaming operation to create as close a seam as possible. The need for self-propelled devices has led to limited variability in terms of the pressure supply on the side opposite the seaming portions of a subject apparatus. Thus, rollers have been the standard components for such a purpose. As noted above, such standard components exhibit drawbacks in the finished seamed roof assembly that have yet to be overcome. To date, then, no viable suggestions for replacing the roller components of a roof seaming apparatus have been provided the industry.

ADVANTAGES AND SUMMARY OF THE INVENTION

One distinct advantage of the inventive apparatus and method is to provide extremely strong and uniformly formed seals at the female/male portion interface of an elevated seam roof assembly. Additionally, a distinct advantage of the inventive seaming apparatus is the ability to reduce potential dimpling and other physical results due to uneven pressure application during the seaming operation. Yet another advantage of such an inventive apparatus is the reliability provided to the user that the motorized apparatus will exhibit a reduced propensity jam or otherwise fail during installation due to slippage of the apparatus during propulsion across the length of the target vertical panel portions.

Accordingly, this invention encompasses a roof panel seaming apparatus including a plurality of rollers suitably configured to permit secure coverage by a belt component (preferably, though not necessarily elastomeric or fabric in nature) and simultaneous movement around said plurality of rollers, wherein said belt component is attached to said rollers for continuous contact to the vertical portion of at least one of a female and male roof panel portion during a seaming operation along the length of two contacted roof panels, wherein said apparatus also includes another series of rollers disposed to create a seam between said female and male roof panel portions when activated along the length of said roof panel portions simultaneously while said belt component is in constant contact with said vertical portion of the same roof panel portions. Also encompassed within this invention is a roof seaming apparatus as described above, wherein said apparatus further includes another set of rollers configured perpendicular to said belt component and to allow for secure attachment of a second belt component thereto, wherein said second belt component is attached to said rollers for continuous contact to an overlapping female panel portion of a roof panel during a seaming operation between a male portion of one panel and said female portion of another panel. Further encompassed within this invention is a method of creating a seam between two roof panels including a female edge portion and a male edge portion present in overlapping relation to one another, said method comprising:

a) providing a first roof panel having an elevated female end portion and an opposite elevated male portion, said female portion having an edge, and said male portion having an edge substantially parallel to said female portion edge, providing a second roof panel substantially identical to and having the same type of female and male end portions as said first roof panel, wherein said first and second roof panels are placed in overlapping, parallel relation to each other, wherein said female end portion of said first roof panel is present over said male end portion of said second roof panel;

b) placing the apparatus described above aligned for engagement with female and male roof panel portions of separate but adjacent panels at the same time, wherein said belt component provides continuous pressure to the vertical portion of the female panel portion simultaneously as the creasing rollers supply the seam to the overlapping end portions of said adjacent panels on the side opposite that to which said belt component is present;

c) activating said apparatus thereby permitting automatic movement of the apparatus over the overlapping end portions of said first and second roof panels in a direction parallel to the direction in which said first and second roof panels are placed on said roof; and d) removing said apparatus upon completion of movement over said overlapping first and second roof panel end portions. The same method with the extra second belt component is yet another embodiment encompassed within this invention.

In this manner, an entire roof assembly including such particular panels having elevated end portions for seaming may be reliably attached to one another in series with constant and continuous pressure being supplied by the belt component or both belt components during the seaming operation. In addition, the utilization of such belt component(s) permits reliability in terms of traction during operation (not only if moisture, oil, or other potential low viscosity liquids are present during roof assembly, but also as a general rule), thereby not only supplying the necessary forces against the creasing rollers to effectuate a strong seam along the length of the adjacent panels, but also to provide reliable movement of the entire apparatus along such panels as well.

Such roof seaming devices are, as noted above, self-propelling in nature to permit two installers to situate themselves at opposing ends of a to-be-installed roof assembly for proper operation. A first installer will place a seaming apparatus in place over the overlapping ends of a male end of a first roof panel and a female end (the outer panel) of a second roof panel and activate a switch to allow the rollers in place to move the apparatus along the length of the contacted adjacent roof panels. The device is intended to move along that length by itself until the second installer receives it and then returns it to the first installer to then apply the creasing apparatus on the next overlapping roof section panels, with the repeat of such an action until all of the panels have been seamed together as necessary. Unfortunately, potential problems with proper traction, gripping, etc., of the subject roof seaming apparatus may occur with rollers alone as, again, merely tangential pressures are applied to the target panels during seaming operations. As these rollers are generally metal in nature, in order to supply the necessary high forces for proper seaming operation initially, the potential lack of sufficient friction between a metal roller and a metal panel may result in a noticeable lack of desired movement along the panel lengths. Furthermore, the potential for slippage of such metal rollers may contribute to unwanted jamming of the entire apparatus during use as well through movement at improper angles (rather than a straight line) during roof seaming. The resultant roof provided by such seamed joints thus exhibits excellent strength due to the uniform seams present therein.

In the roofing industry, it is evident that an edifice is first erected through providing the building skeleton (girders, beams, etc.) as well as potentially, particularly for commercial buildings, brick, stone, or other like materials for outside walls. The roof thus must be constructed on site, and atop the building skeleton. Multiple types of roofing materials could be utilized for such a purpose; the types at which the inventive apparatus and method are directed are those that involve relatively long, but relatively narrow, panels that, as discussed throughout, are attached through seams to produce a single roof assembly. Such panels include the elevated female and male members as noted above for such seaming purposes; in addition, though, the seams provide excellent characteristics in relation to thermal expansion and contraction possibilities, in addition to the low slippage and watertight properties highly desired. The stronger the seam, however, the better the overall protection to the roof assembly from damaging high winds.

Such panels are generally made from different gauge metals (such as steel, stainless steel, aluminum, and the like), and are selected in terms of their load properties, among other reasons. The flexibility of the panels is important in terms of the above-discussed characteristics for thermal expansion and wind resistance; however, the load itself also contributes to the potential difficulties with seaming of the elevated end portions together as well. This potential issue can be compensated for with the aforementioned proper motorized seaming apparatus (such as a motor attached to a movable base) exhibiting the proper torque to maneuver the female and male end portions as needed for proper seaming to be accomplished. Generally, aluminum exhibits the lowest gauge and thus is easier on the motor of the seaming apparatus; however, such a material also exhibits the least reliability in terms of roof assembly panels as well, due to its malleability level. Steel and stainless steel (and other like higher gauge metals) are thus preferred. Additionally, to protect from environmental and water damage, the metal surface is usually accorded a proper coating (anti-rust paint, for example).

Furthermore, the adjacently disposed roof panels are supported by an underlying support structure to which the panels may also be attached through clips or other like objects. Backer and/or cinch plates may be added to the overlapped edge seams in the roof assembly as well, if desired, to increase the overall strength of the roof.

The belt components of the inventive roof seaming apparatus should be constructed of materials that exhibit sufficient strength and resiliency to propel the apparatus along metal panels repetitively. Thus, the belt components must provide sufficient friction for such a purpose. In addition, the belt components must exhibit sufficient flexibility to properly apply pressure to the target panel(s) during seaming, propel, as noted above, the apparatus along the length of such panel (s), and move around inner rollers that provide the needed propulsion force while applying pressure to the target panel (s). In other words, the belt components must not lock up while in use due to excessive forces applied on the target panel(s), but must move without slipping from the set course desired by the operator/installer along the length of the target panel(s). Thus, rubber belts with properly etched or molded tread would be one potentially preferred material (natural rubber, styrene butadiene rubber, silicone rubber, nitrile butadiene rubber, ethylene diene propylene monomer rubber, are all possible types, among many others). Fabric belts with properly woven patterns to aid in gripping the roller and panel surfaces may also be utilized, preferably made from strong fibers, such as polyaramid, polypropylene, and nylon, as merely examples. Another potentially preferred material is a rubber to which a fabric (both of the types noted above) has been strongly adhered to, with the patterned fabric on the outer portion thereof to contact the panel surface. Alternatively the fabric may be formed in a woven pattern and rubber may be adhered to the outer surface as well (through dipping, coating, and the like) in order to provide a strong reduced-slip surface for the belt component itself.

The first belt component noted above is situated in such a manner as to apply pressure and move along the length of the vertically configured female end portion (the outer panel) of one of two adjacent contacted to-be-seamed roof panels (the male portion of the other roof panel is present underneath the female portion of the first panel and is only in contact with the creasing rollers of the apparatus, not the belt component or components of the device). The second belt component, optionally present, but certainly another preferred embodiment of the invention, is provided in perpendicular relation to the first belt component when present as part of the inventive roof seaming device. However, this second belt component is configured to contact the horizontal portion of the female end portion of the to-be-seamed panel instead of the vertical portion. In this manner, greater pressure to ensure the seaming apparatus remains in the correct direction during operation is provided while simultaneously increasing the tension and friction of the overall device for quick, reliable self-propulsion of the device along the seamed panel lengths as well. Such a second belt component is also situated around a plurality of rollers that aid in provide rotational movement for propulsion of the apparatus during operation, but may exhibit undesirable slippage and marring, etc., of the horizontal (top) female panel portion at the same time due to the metal-metal contact that would be necessary. As such, this second belt component aids in keeping the apparatus in proper alignment for all of the benefits, unexpected in total, obtained in relation to such an inventive single belt usage. As the previous roof seaming devices all relied solely upon metal rollers for operation in the past, the utilization of belt components over such rollers now provides greater reliability overall to during the seaming operation, faster installation times, aesthetically pleasing and uniform creasing results, low marring, dimpling, or other unpleasant appearances on the final seamed roof assembly, lower propensity for roof compromise due to uneven seaming, and other benefits.

Such belt components are preferably elastomeric in nature, such as made from nitrile butadiene rubber (NBR), styrene butadiene rubber (SBR), ethylene-propylene diene monomer rubber (EPDM), or silicone rubber (EPDM). The belt itself may also be coated with a textile component for reinforcement, or a sprayed on coating of a different rubber component may be applied for reinforcement as well as increased grip strength. The belt itself may be notched, or serpentine, or V-shaped, again to provide increased contact with the target roof panel sections. Preferably, a V-shaped configuration is utilized with NBR and with a polyester textile coating present on the side of the belt in contact with the target roof panel.

The features, benefits and advantages of the present invention will become apparent from the following detailed description when read in conjunction with the drawings and appended claims.

DETAILED DESCRIPTION OF THE DRAWINGS

Figure 1:
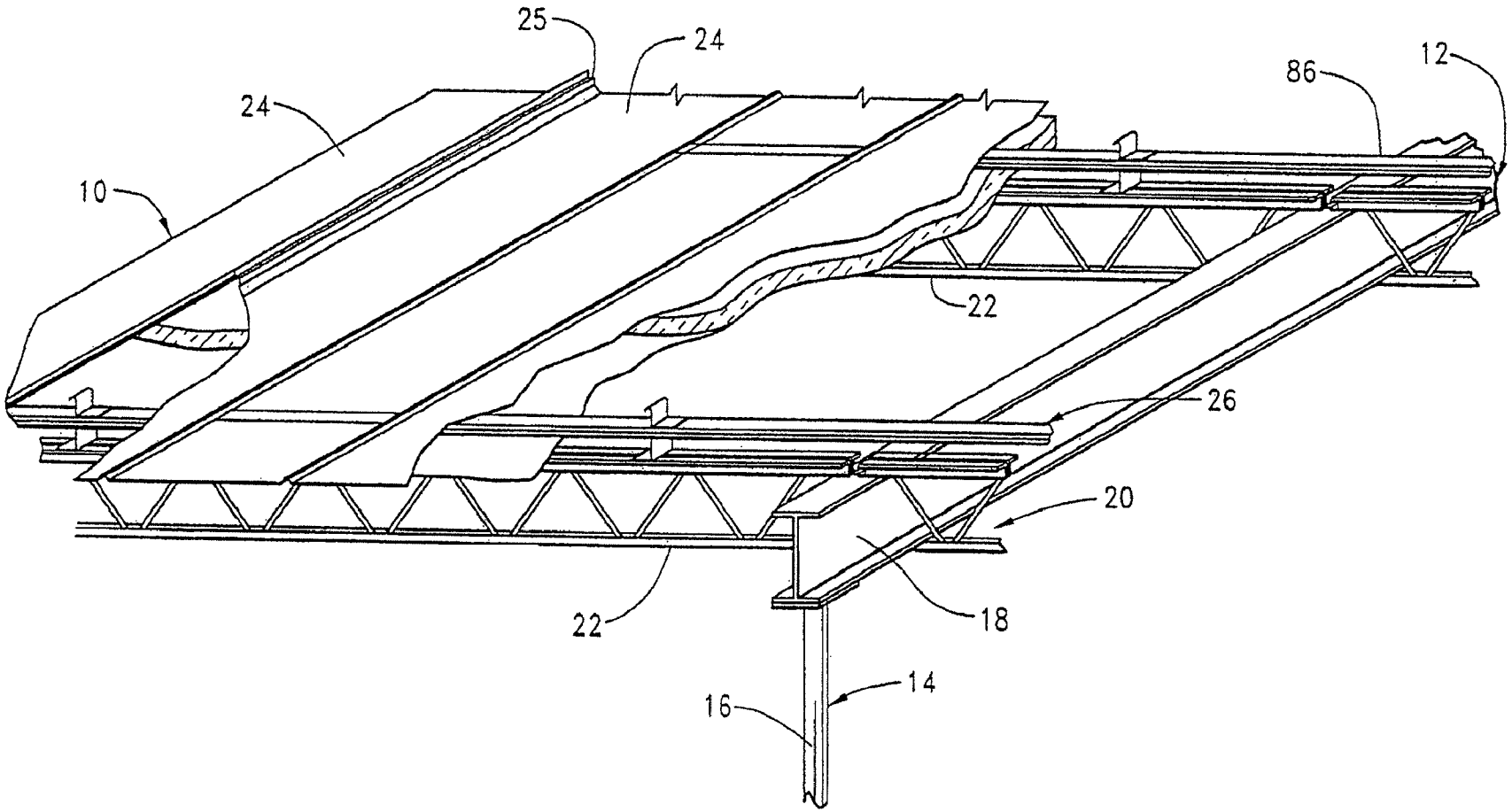
FIG. 1 is an isometric, partial cut-away view of a portion of a roof system utilizing a standing seam roof assembly.

Referring to FIG. 1, there is depicted a pre-engineered building roof 10 supported by a pre-engineered building structure 12. Such a pre-engineered structure 12 comprises a primary structural system 14 including a number of upwardly extending column members 16 [to be connected to a base foundation (not illustrated)]. Also, the primary structural system 14 has a plurality of beams 18 which are supported by the column members 16.

Also included is a secondary structural system 20 including a number of open web beams 22 attached to and supported horizontally by the primary beams 18. Alternative structures may be employed in place of these web beams 22, if desired. A plurality of roof panels 24 are supported over the secondary structural assembly 20 by a plurality of panel support assemblies 26 and are attached to the upper flanges of the web beams 22. The roof panels 24, only portions of which are shown, are depicted as being standing seam panels with interlocking standing seams 25 connected by clip portions of the panel support assemblies 26. Alternatives to such clips may be practiced as well and other clips may be incorporated within the panels to hold them in place with the building skeletal portions noted above.

Figure 2:
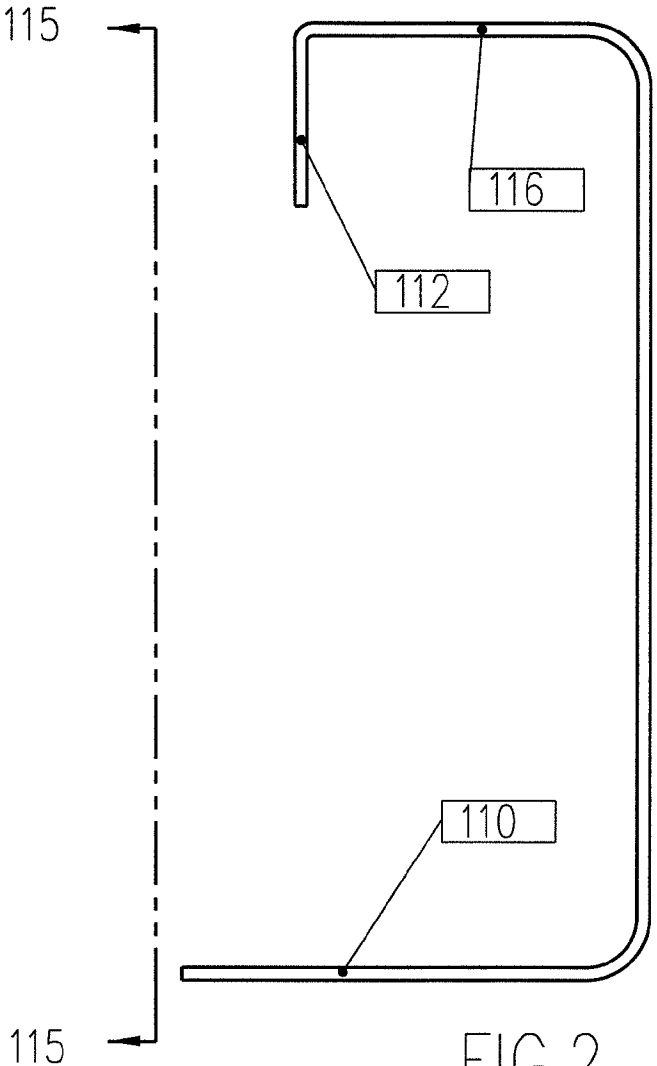
FIG. 2 is a cross-sectional view of the male end portion of a roof panel.

FIG. 2 depicts the male end portion 115 of an end panel (partially shown as 110). The end portion 115 includes an elevated end component 114 that bends substantially 90 degrees from the plane of the panel 110 that leads into a top end component 116 that bends substantially 90 degrees from the plane of the elevated end component 114 back toward the panel 110 and is substantially parallel to the panel itself 110. Another substantially 90 degree bend in the material then leads to an edge portion 112 being the edge of the entire panel 110 on the male portion side 115. This edge portion 112 is parallel with the elevated end component 114. The top end component 116 is thus raised to a predetermined height through the length of the elevated end component 114. The edge portion 112 is extended a predetermined length from the top end portion 116 as well.

Figure 3:
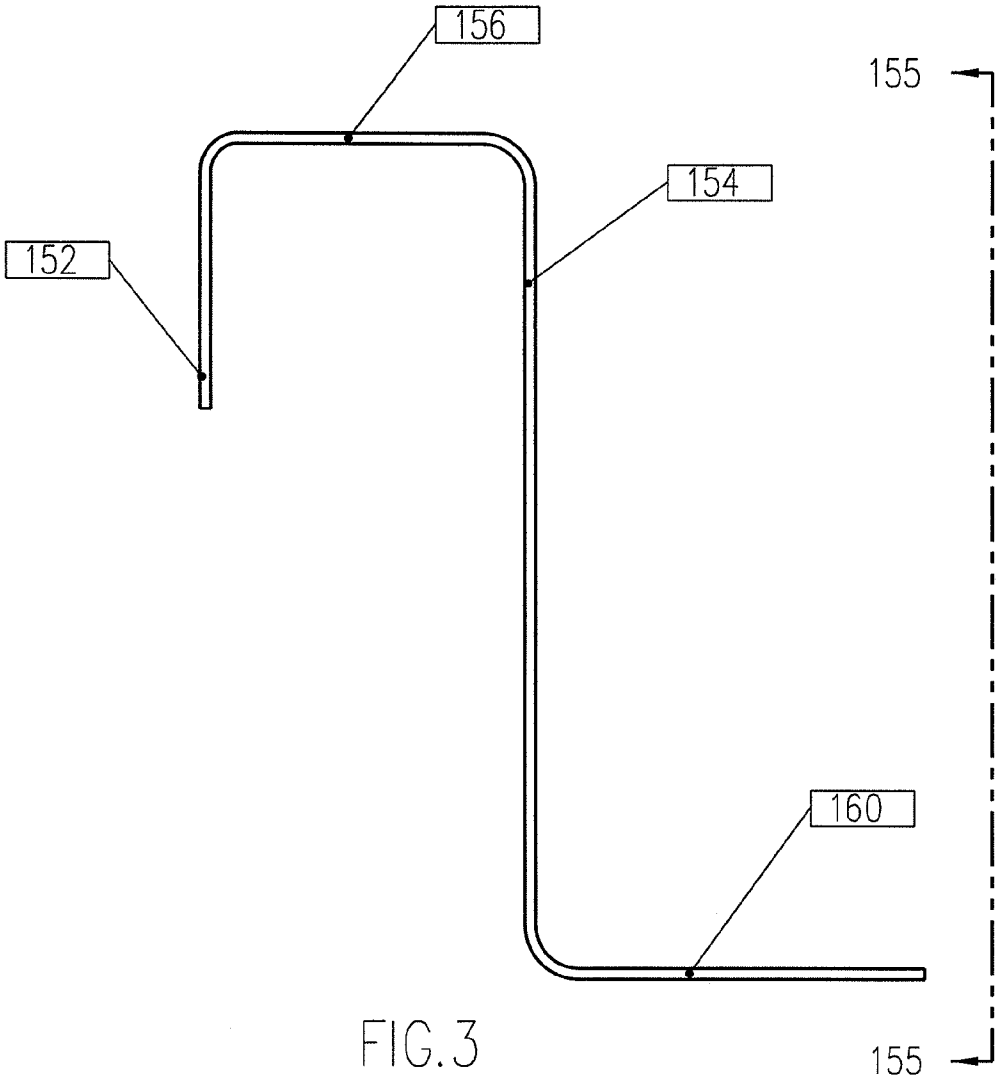
FIG. 3 is a cross-sectional view of the female portion of a roof panel.

FIG. 3 depicts a female end portion 155 of a panel (partially shown as 160) with an elevated end portion 154 that bends substantially 90 degrees from the plane of the panel 160 that leads into a top end component 156 that bends substantially 90 degrees from the plane of the elevated end component 154 and away from the panel 160 and is substantially parallel to the panel itself 160. Another substantially 90 degree bend in the material then leads to an edge portion 152 being the edge of the entire panel 160 on the female portion side 155. This edge portion 152 is parallel with the elevated end component 154. The top end component 156 is raised to a predetermined height in relation to the height of the male portion side (115 of FIG. 2) in order to permit snug engagement of the male portion side (115 of FIG. 2) under and within the female portion side 155. As well, the edge portion 152 is provided at a length longer than that of the male portion side edge portion (112 of FIG. 2) in order to accomplish this snug fit in addition to permitting effective seaming of the two portion sides (115 of FIG. 2 and 155 of FIG. 2). Each panel used in roof construction will have one male side portion and one female side portion (as alluded to in FIG. 1, above).

Figure 4:
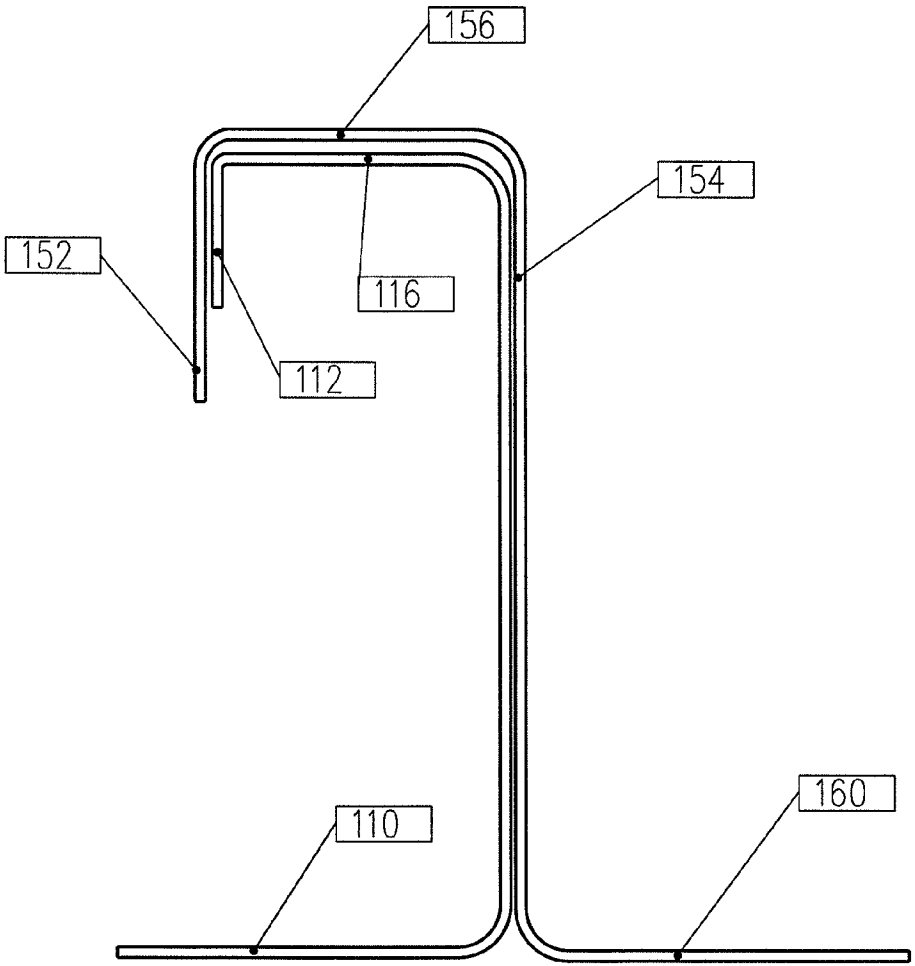
FIG. 4 is a cross-sectional view of interlocked female and male portions of two roof panels prior to seaming.
Figure 5:
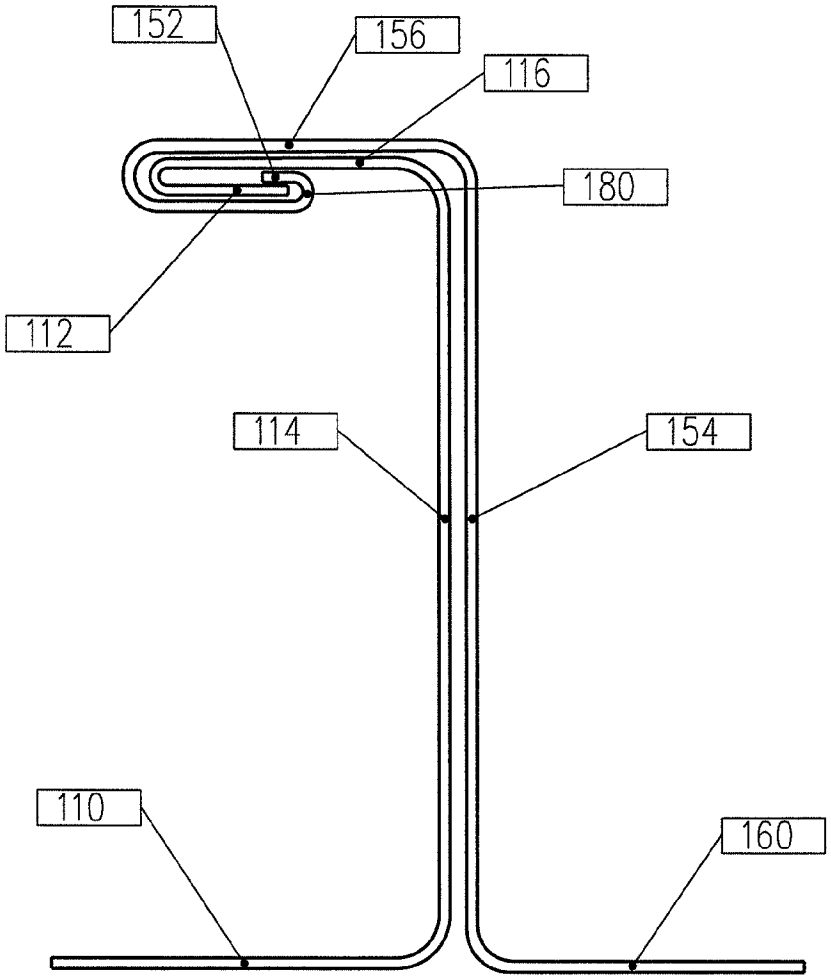
FIG. 5 is a cross-sectional view of interlocked female and male portions of two roof panels subsequent to seaming.

FIG. 4 thus shows the engagement of the two portion sides of the two panels 110, 160 through placement of the female elevated end component 154, the female top end component 155, and the female edge portion 152 over the male elevated end component 114, the male top end component 116, and the male edge portion 112. Upon seaming, as depicted in FIG. 5, through the utilization of the inventive seaming apparatus (such as 210 in FIG. 6), the two panels 110, 160 are maneuvered at their male and female edge portions 112,152 to form a strong seal. The elevated end portions 114, 154 and the top end portions 152, 156 remain in substantially the same shape and dimensions as prior to seaming. This resultant seamed combination of roofing panels is thus repeated in sequence with a plurality of such panels to form a roof (as shown in FIG. 1).

These FIGS. 6-10 depict different potentially preferred embodiments of the same general apparatus for seaming a target interlocked set of roofing panels (as shown in FIG. 5). It is important to note, however, that these two different apparatus are but two of many possible configurations that comply with the basic invention. The basic limitation is the provision of multiple same-width drive belts on the apparatus opposite the side including creasing rollers; the second embodiment includes, as noted above, a second set of multiple same-width drive belts perpendicular to such a first set of multiple drive belts. In both instances, the importance is the unexpected benefit from utilizing such a second multiple drive belt configuration in one or both locations to reduce slippage, reduce marring possibilities, and, at least, also to improve the overall seam strength of the finished roof itself.

As is customary in such seaming assemblies, there is provided simultaneous adjustability through the same control mechanism of the contact angle and engagement of at least one seaming roller and a damping mechanism present external to a base module. The proceeding depictions show the general manner of supplying and utilizing the creasing rollers in combination with these inventive drive-belt components to effectuate the desired seamed roof assembly itself.

The components of the apparatus may be of virtually any material of suitable strength to impart sufficient torque and resist rupture or any other like structural failure during a seaming operation. Certain parts may be of plastic construction if they are not in contact with the targeted roof panels themselves (such as handle covers, adjusting shafts, and the like) or used as wheel components. To initiate the seaming process, it may be necessary for the installer to utilize a manual crimper on the first few inches of the target overlapping panels.

Figure 6:
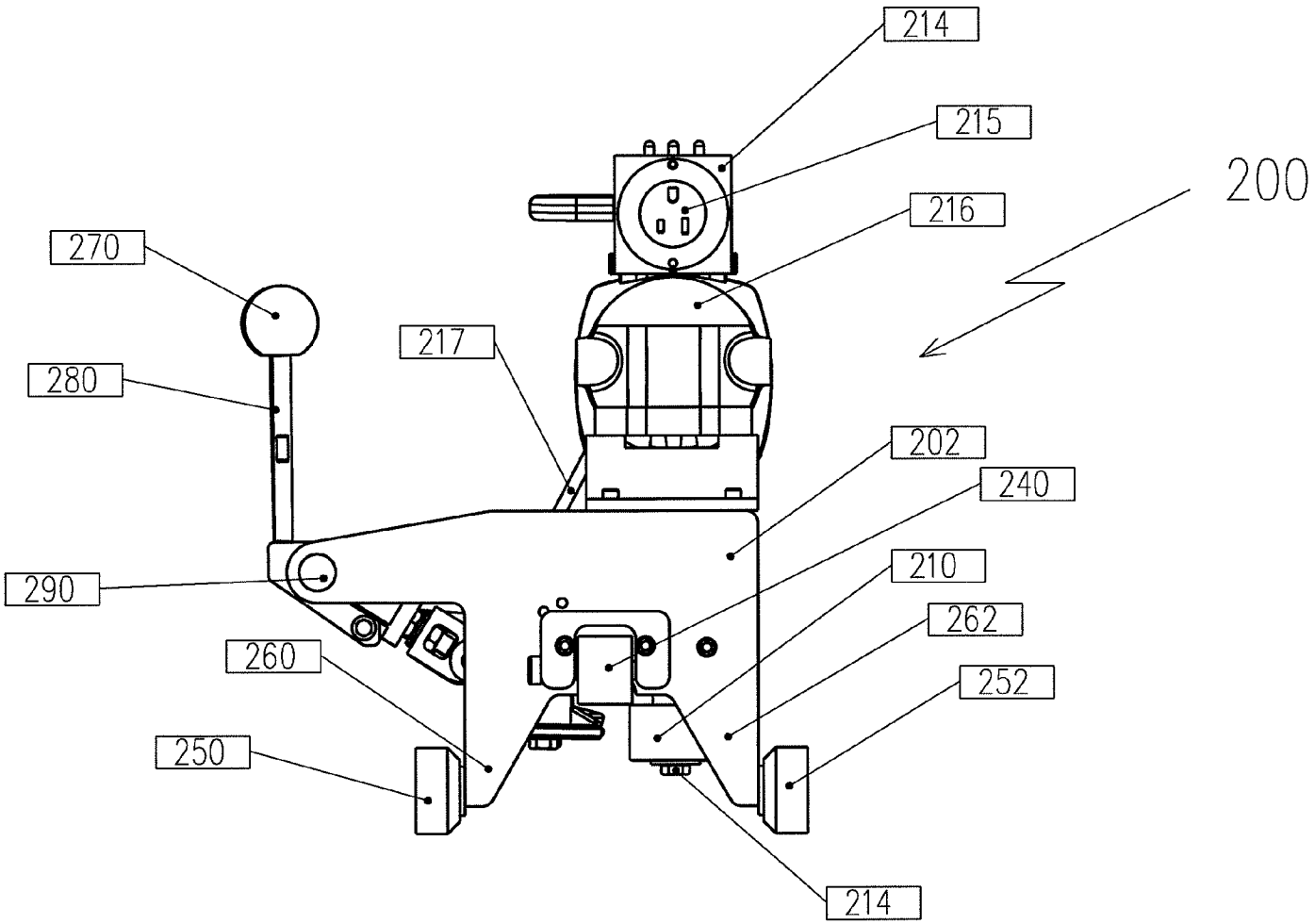
FIG. 6 is a long side view of one embodiment of an inventive roof panel seaming apparatus with a single full-width belt component placed in contact with the vertical female portion of a roof panel, creasing rollers engaged with the interlocked female and male portions of two roof panels subsequent to seaming, and another single full-width belt placed in contact with the horizontal overlapping female portion of a roof panel, perpendicularly situated in relation to the other belt component.
Figure 7:
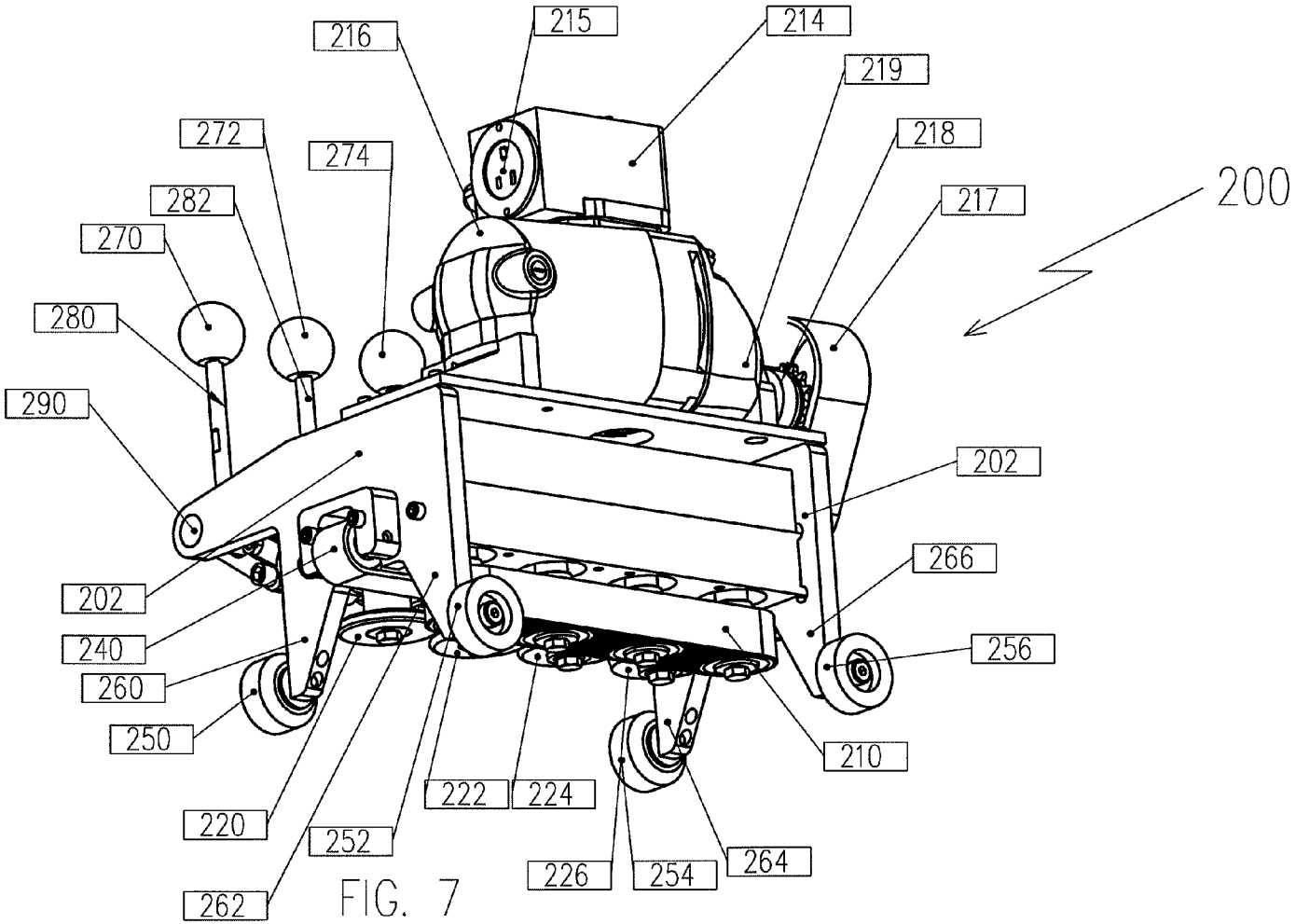
FIG. 7 is a side lower perspective view of the inventive roof panel seaming apparatus of FIG. 6.
Figure 8:
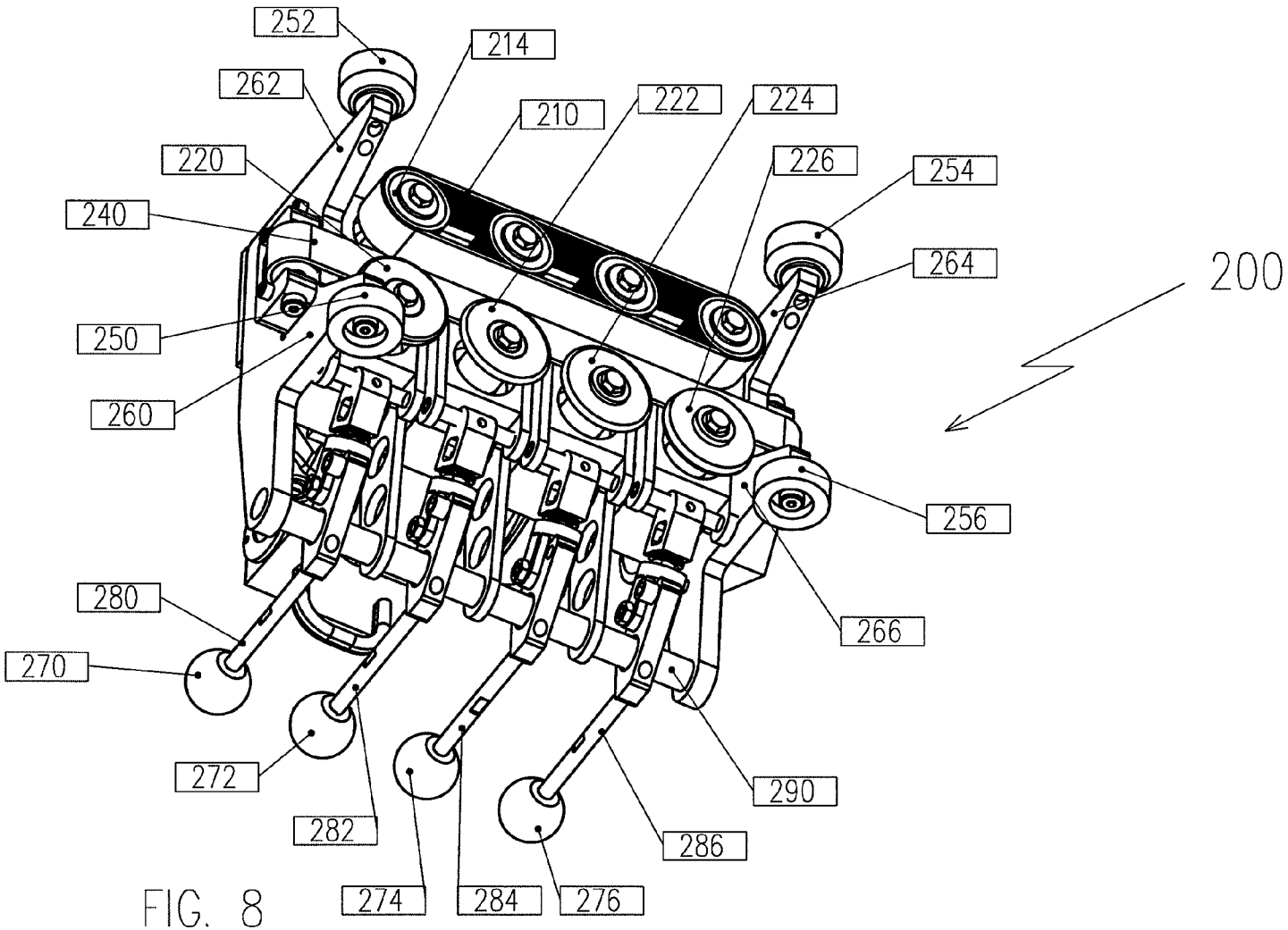
FIG. 8 is an elongated, upside-down view of the inventive roof panel seaming apparatus of FIG. 6.

As depicted, then, in FIGS. 6, 7, and 8, a seaming apparatus 200 is provided with a base component 202 including lower arms 260, 262 (264, 266 in FIG. 7) to which rotatable wheels 250, 252 (254, 256 in FIG. 7) are attached. The base 202 is designed to straddle an elevated interlocked female/male end portion combination 241 of two roof panels (110, 160 of FIG. 5, for example), wherein the only portions of such panels that are not substantially flat (i.e., in substantially the same plane) are elevated portions 242 and the edges 243. The combination 241 is engaged at the overlapping edges 243 of these panels (110, 160 of FIG. 5). The combination 241 exhibits a vertical elevated portion 242 comprised of the same two panels (110, 160 of FIG. 5) as well as a horizontal top portion 244. As well, the apparatus will include, preferably, a motor (not illustrated, but present within a housing 216 in FIGS. 6-8; 316 in FIGS. 9 and 10) to provide automation for movement of the seaming assembly across subject interlocking portions of such roof panels as well through a chain/sprocket mechanism 218, 219 in FIG. 7 (318 in FIG. 9). The chain/sprocket 218 (318 in FIG. 9) transfers power to the main shaft drive assembly 219 (319 in FIG. 9) to power the entire apparatus 200 (300 in FIGS. 9 and 10) during use. Power is supplied through an electrical cable (not illustrated) that is plugged into an outlet 215 in FIGS. 6 and 7 (315 in FIGS. 9 and 10) present, in this embodiment, within a separate diagnostic instrument housing 214 (314 in FIGS. 9 and 10). A separate housing 217 (317 in FIGS. 9 and 10) partially covers the chain/sprocket 218 (318 in FIG. 9) to protect such machinery during use as well as protect a user simultaneously.

These FIGS. 6-10 depict different potentially preferred embodiments of the same general apparatus for seaming a target interlocked set of roofing panels (as shown in FIG. 5). It is important to note, however, that these two different apparatus are but two of many possible configurations that comply with the basic invention. The basic limitation is the provision of a multiple full-width drive belt on the apparatus opposite the side including creasing rollers; the second embodiment includes, as noted above, a second drive-belt perpendicular to such a first full-width drive belt. In both instances, the importance is the unexpected benefit from utilizing such a multiple drive-belt configuration in one or both locations to reduce slippage, reduce marring possibilities, and, at least, also to improve the overall seam strength of the finished roof itself.

As is customary in such seaming assemblies, there is provided simultaneous adjustability through the same control mechanism of the contact angle and engagement of at least one seaming roller and a damping mechanism present external to a base module. The proceeding depictions show the general manner of supplying and utilizing the creasing rollers in combination with these inventive drive-belt components to effectuate the desired seamed roof assembly itself.

The components of the apparatus may be of virtually any material of suitable strength to impart sufficient torque and resist rupture or any other like structural failure during a seaming operation. Certain parts may be of plastic construction if they are not in contact with the targeted roof panels themselves (such as handle covers, adjusting shafts, and the like) or used as wheel components. To initiate the seaming process, it may be necessary for the installer to utilize a manual crimper on the first few inches of the target overlapping panels.

As depicted, then, in FIGS. 6, 7 and 8, a seaming apparatus 200 is provided with a base component 250 including lower arms 251, 252 (251, 252, 253, 254 in FIGS. 7 and 8) to which rotatable wheels 255, 256 (255, 256, 257, 258 in FIGS. 7 and 8) are attached. The base 250 is designed to straddle an elevated interlocked female/male end portion combination 241 of two roof panels (110, 160 of FIG. 5, for example), wherein the only portions of such panels that are not substantially flat (i.e., in substantially the same plane) are elevated portions 242, 243 and the edges 244. The combination 241 is engaged at the overlapping edges 244 of these panels (110, 160 of FIG. 5). The combination 241 exhibits a vertical elevated portion 233 comprised of the same two panels (110, 160 of FIG. 5) as well as a horizontal top portion 234. Also included is one single belt drive 210 configured around a set of rollers 214 and arranged to apply pressure continuously alone the vertical portion of overlapping roof panel sections 244 during seaming. In addition, a single belt drive 240 is present arranged to apply continuous force to the horizontal portion of overlapping roof panel sections 243 during seaming. Alternatively, this second belt drive 240 may be of single or more than double belt configuration if desired or not present at all (as in FIGS. 9 and 10).

The remaining components of the apparatus 200 are present to effectuate the needed seaming of the overlapping edges 242 along the length of the combination 241. To accomplish such a seaming operation, in this embodiment, there are provided four rollers 220 (222, 224, 226 in FIGS. 7 and 8) oriented horizontally in relation to the target panels (110, 160 in FIG. 5). These horizontal (creasing) rollers 220 (222, 224, 226 in FIGS. 7 and 8) may be adjusted in terms of distance from the overlapping edges 244, as well as in terms of height. It is generally preferred to begin the seaming operation through the utilization of the first horizontal creasing roller 220 disposed at a height lower than the second horizontal creasing roller 222 (FIGS. 7 and 8), to initiate the movement of the overlapping edges 244 to a position towards parallel to the top end portion 234. The second horizontal creasing roller 222 (FIGS. 7 and 8) then moves the edges 244 to an even closer position to that desired end result. The third horizontal creasing roller 224 (FIG. 7) is then disposed at a height even higher than the second roller 222 (FIGS. 7 and 8) to bring the edges 244 even closer together. The last horizontal creasing roller 226 (FIGS. 7 and 8) is then disposed at a height higher than the third roller 224 (FIGS. 7 and 8) to complete the desired folding of the overlapping edges 244 to the desired parallel position as noted above (such as depicted in FIG. 5). These rollers 220 (222, 224, 226 in FIGS. 7 and 8) are all adjustable through lever devices 270 (272, 274, 276 in FIGS. 7 and 8) rotatable around the same shaft 290 via individual to shafts 280 (282, 284, 286 in FIGS. 7 and 8).

Figure 9:
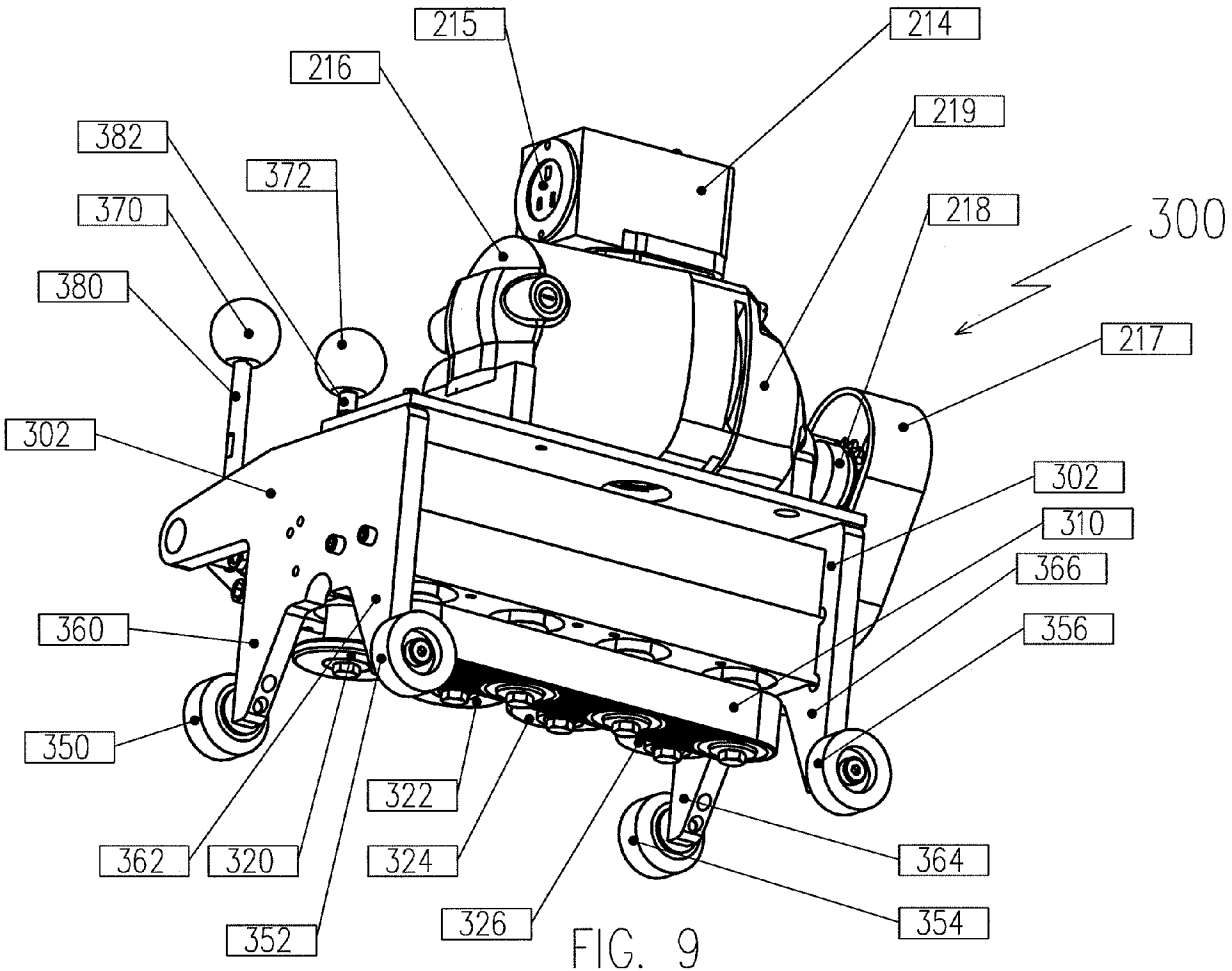
FIG. 9 is a side lower perspective view of one embodiment of an inventive roof panel seaming apparatus with a single full-width belt component placed in contact with the vertical female portion of a roof panel and creasing rollers engaged with the interlocked female and male portions of two roof panels subsequent to seaming.
Figure 10:
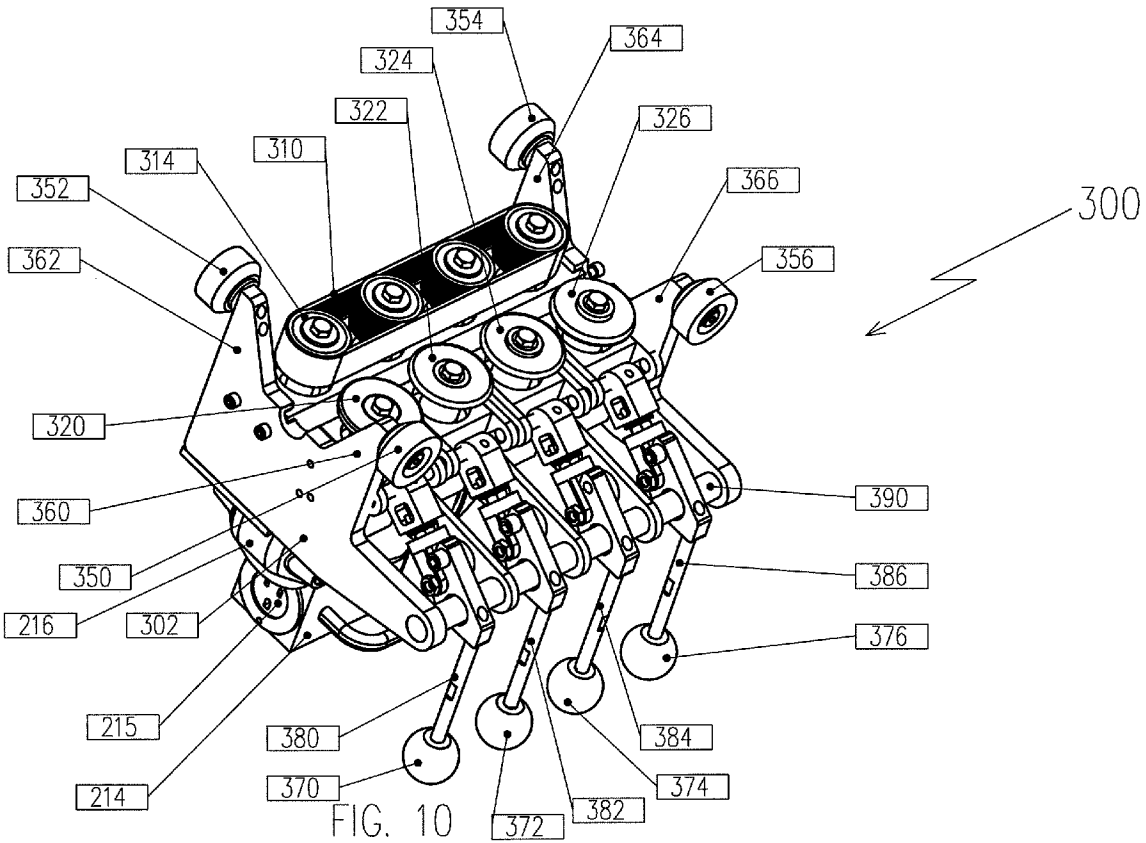
FIG. 10 is an elongated, upside-down view of the inventive roof panel seaming apparatus of FIG. 9.

In terms of FIGS. 9 and 10, the apparatus 300 with only one single drive belt 310 (around a set of rollers 314) is depicted with all of the same components as in FIGS. 6-8, above. The apparatus 300 includes a base 302 including four arms 360, 362, 364, 366 with four rotatable wheels attached thereto 350, 352, 354, 356, and configured, as for the apparatus above, to straddle a combination (241 in FIG. 6). To accomplish such a seaming operation, in this embodiment, there are provided four rollers 320, 322, 324, 326 oriented horizontally in relation to the target panels (110, 160 in FIG. 5). These horizontal (creasing) rollers 320, 322, 324, 326 may be adjusted in terms of distance from the overlapping edges (244 in FIG. 6, for example), as well as in terms of height, as described above for FIGS. 7 and 8. These rollers 320, 322, 324, 326 are all adjustable through lever devices 370, 372, 374, 376 rotatable around the same shaft 390 via individual shafts 380, 382, 384, 386. The juxtaposed single drive belt 310 thus applies force against the vertical portion of the combination (241 in FIG. 6) opposite that of the creasing rollers 320, 322, 324, 326 during seaming to permit a stronger seam to be produced.

The apparatus may include a damping post to guide proper placement of the roof panel portions during seaming. As well, the apparatus will include, preferably, a motor (as discussed above) to provide automation for movement of the seaming assembly across subject interlocking portions of such roof panels as well. Alternatively, an apparatus may be used that includes two sets of each component noted in the FIGS. 6-10, but disposed atop the provided apparatus in mirror image to such components. In such a manner, two users may be employed to start the apparatus along one set of roof panels, and the second user may return it to the other by flipping the apparatus over and seaming the next combination of roofing panels as well. Such a process is extremely efficient and is well within the scope of this invention as long as at least one set of components includes the necessary vertical roller to create the hook within the target female edges during a seaming operation. The resultant roof assembly thus exhibits the highly desired level of strength, reliable results, reduced marring, and reduced possibility for slippage and/or jamming of the automated assembly during use.

In comparison with steel rollers and fiber rollers that are currently in use in typical roof seaming devices, the single drive belt configuration described in detail above provides much higher pounds of force to subject overlapping roof panel sections, thereby applying a much more reliable, stronger seal seam. Standard measurements taken in a controlled, standard environment (in terms of humidity, pressure, and temperature) and using the same certified Dynamometer, were 60 pounds for steel rollers and 118 pounds for fiber rollers; the inventive single belt drive exhibited 264 pounds in comparison, a greater than 4× increase over steel rollers and nearly a 2.5× increase over fiber rollers, quite an unexpectedly effective result.

It will be understood that various changes in the details, materials, and arrangements of the parts which have been described and illustrated herein in order to explain the nature of this invention may be made by those skilled in the art without departing from the principles and scope of the invention as expressed in the following claims.

What is claimed is:

1. A roof panel seaming apparatus including a plurality of rollers suitably configured to permit secure coverage by a belt component and simultaneous movement around said plurality of rollers, wherein said belt component is attached to said rollers for continuous contact to the vertical portion of at least one of a female and male roof panel portion during a seaming operation along the length of two contacted roof panels, wherein said apparatus also includes another series of rollers disposed to create a seam between said female and male roof panel portions when activated along the length of said roof panel portions simultaneously while said belt component is in constant contact with said vertical portion of the same roof panel portions.

2. A roof seaming apparatus as described in claim 1, wherein said apparatus further includes another set of rollers configured perpendicular to said belt component and to allow for secure attachment of a second belt component thereto, wherein said second belt component is attached to said rollers for continuous contact to an overlapping female panel portion of a roof panel during a seaming operation between a male portion of one panel and said female portion of another panel.

3. A method of creating a seam between two roof panels including a female edge portion and a male edge portion present in overlapping relation to one another, said method comprising:

a) providing a first roof panel having an elevated female end portion and an opposite elevated male portion, said female portion having an edge, and said male portion having an edge substantially parallel to said female portion edge, providing a second roof panel substantially identical to and having the same type of female and male end portions as said first roof panel, wherein said first and second roof panels are placed in overlapping, parallel relation to each other, wherein said female end portion of said first roof panel is present over said male end portion of said second roof panel;

b) placing the apparatus described in claim 1 aligned for engagement with female and male roof panel portions of separate but adjacent panels at the same time, wherein said belt component provides continuous pressure to the vertical portion of the female panel portion simultaneously as the creasing rollers supply the seam to the overlapping end portions of said adjacent panels on the side opposite that to which said belt component is present;

c) activating said apparatus thereby permitting automatic movement of the apparatus over the overlapping end portions of said first and second roof panels in a direction parallel to the direction in which said first and second roof panels are placed on said roof; and d) removing said apparatus upon completion of movement over said overlapping first and second roof panel end portions.

4. A method of creating a seam between two roof panels including a female edge portion and a male edge portion present in overlapping relation to one another, said method comprising:

a) providing a first roof panel having an elevated female end portion and an opposite elevated male portion, said female portion having an edge, and said male portion having an edge substantially parallel to said female portion edge, providing a second roof panel substantially identical to and having the same type of female and male end portions as said first roof panel, wherein said first and second roof panels are placed in overlapping, parallel relation to each other, wherein said female end portion of said first roof panel is present over said male end portion of said second roof panel;

b) placing the apparatus described in claim 2 aligned for engagement with female and male roof panel portions of separate but adjacent panels at the same time, wherein said belt component provides continuous pressure to the vertical portion of the female panel portion simultaneously as the creasing rollers supply the seam to the overlapping end portions of said adjacent panels on the side opposite that to which said belt component is present;

c) activating said apparatus thereby permitting automatic movement of the apparatus over the overlapping end portions of said first and second roof panels in a direction parallel to the direction in which said first and second roof panels are placed on said roof; and d) removing said apparatus upon completion of movement over said overlapping first and second roof panel end portions.

* * * * *